US009483985B2

(12) United States Patent
Fan et al.

(10) Patent No.: US 9,483,985 B2
(45) Date of Patent: Nov. 1, 2016

(54) FIELD-SEQUENTIAL-COLOR LIQUID CRYSTAL DEVICE AND THE DRIVING METHOD THEREOF

(71) Applicant: Shenzhen China Star Optoelectronics Technology Co., Ltd., Shenzhen, Guangdong (CN)

(72) Inventors: Yong Fan, Guangdong (CN); Chih-tsung Kang, Guangdong (CN); Sheng-Jer Chang Chien, Guangdong (CN); Xiaoping Tan, Guangdong (CN); Jianjun Xie, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 327 days.

(21) Appl. No.: 14/374,543

(22) PCT Filed: Jul. 1, 2014

(86) PCT No.: PCT/CN2014/081402

§ 371 (c)(1),
(2) Date: Jul. 25, 2014

(87) PCT Pub. No.: WO2015/196500

PCT Pub. Date: Dec. 30, 2015

(65) Prior Publication Data

US 2016/0275885 A1 Sep. 22, 2016

(30) Foreign Application Priority Data

Jun. 26, 2014 (CN) ..... 2014 1 0300916

(51) Int. Cl.

| | |
|---|---|
| ***G09G 3/36*** | (2006.01) |
| ***G09G 3/20*** | (2006.01) |
| ***G09G 3/34*** | (2006.01) |

(52) U.S. Cl.

CPC ..... *G09G 3/3607* (2013.01); *G09G 3/2003* (2013.01); *G09G 3/2074* (2013.01); G09G 3/342 (2013.01); *G09G 3/3413* (2013.01); *G09G 3/3648* (2013.01); *G09G 2300/0452* (2013.01); *G09G 2320/0242* (2013.01); *G09G 2320/0252* (2013.01); *G09G 2330/021* (2013.01)

(58) Field of Classification Search

CPC ..... G09G 3/2003; G09G 3/2074; G09G 3/3413; G09G 3/342; G09G 3/3648; G09G 2300/0452; G09G 2320/0252; G09G 2320/0242; G09G 2330/021

See application file for complete search history.

(56) References Cited

U.S. PATENT DOCUMENTS

2012/0287166 A1* 11/2012 Wyatt ..... G09G 5/006 345/690

FOREIGN PATENT DOCUMENTS

TW 200828235 A 7/2008

*Primary Examiner* — Abbas Abdulselam
(74) *Attorney, Agent, or Firm* — Andrew C. Cheng

(57) ABSTRACT

A driving method of the FSC-LCD is disclosed. The method includes: calculating grayscale values of four pixels of each images, the grayscale values of four pixels comprises grayscale values for a white pixel, for a first color pixel, for a second color pixel, and for a third color pixel; within a first color field of the n-th image, a white backlight source is provided to the pixel cells, the grayscale value for the white pixel of the n-th image is inputted to the transparent subpixel, the grayscale value for the first color pixel of the n-th image is inputted to the first color subpixel, and the grayscale value for the second color pixel of the n-th image is inputted to the second color subpixel; within a second color field of the n-th image, a third-color backlight source is provided to the pixel cells, the grayscale value for the third color pixel of the n-th image is inputted to the transparent subpixel, a grayscale value is inputted to the first color subpixel and the second color subpixel such that the first color subpixel and the second color subpixel remain in a turn-on state. In addition, FSC-LCD driven by the above driving method is also disclosed.

16 Claims, 3 Drawing Sheets

| Image No. | Color field No. | Backlight source | Grayscale value for transparent subpixel | Grayscale value for green subpixel | Grayscale value for blue subpixel |
|---|---|---|---|---|---|
| 0 | 1st | 0 | 0 | 0 | 0 |
| | 2nd | 0 | 0 | W1 | W1 |
| 1st | 1st | W | W1 | G1 | B1 |
| | 2nd | R | R1 | W2 | W2 |
| 2nd | 1st | W | W2 | G2 | B2 |
| | 2nd | R | R2 | W3 | W3 |
| 3rd | 1st | W | W3 | G3 | B3 |
| | 2nd | R | R3 | W4 | W4 |
| ... | ... | ... | ... | ... | ... |

FIELD-SEQUENTIAL-COLOR LIQUID CRYSTAL DEVICE AND THE DRIVING METHOD THEREOF

BACKGROUND OF THE INVENTION

1. Field of the Invention

The present disclosure relates to liquid crystal display technology, and more particularly to a field-sequential-color liquid crystal display (FSC-LCD) and the driving method thereof.

2. Discussion of the Related Art

LCDs are thin display devices having a number of colorful or black/white pixels. Generally, the LCDs are disposed in front of a light source or a reflective sheet. The LCDs have been widely adopted in electronic devices, for instance, computing devices, mobile phones, and digital cameras with display panels.

Conventional Thin-Film Transistor Liquid Crystal Displays (TFT-LCDs) adopt white backlight source together with color filter (CF) substrate including red (R), blue (B), and green (G) color filters to display colors. With such configuration, the CFs may cause the light loss, which is approximately a ratio of 2 out of 3. In order to enhance the light efficiency, the FSC-LCD is developed, which, instead of adopting the RGB CFs, adopts color fields of RGB to light in turn during the period of one image. Within the duration of vision, the backlight of three colors are mixed so as to display colorful image. However, color breakup issue may occur for traditional FSC-LCDs. For instance, for a motional image including a moving object, users eyes tracks the moving objects. When a relative speed exists between users eyes and the displayed image, the three color fields may cause the color breakup in different location of the retinas. As such, the users may detect the dizzy colors at different levels around the edges of the moving objects. In addition, the refresh rate of the FSC-LCDs, which have not included color filters, has to be at least 180 HZ such that the display quality may be ensured.

In order to own the attributes, such as high color range, high transmission rate, and low power consumption, in order to resolve the color breakup issue and reduce the refresh rate of images, recently, the FSC-LCD having two color photoresists and one transparent photoresist is developed, whose refresh rate is about 120 HZ. As shown in FIG. 1. The CF substrate of the LCD includes a transparent photoresist, a green photoresist, and a blue photoresist corresponding to each pixel cells. The backlight module of the LCD provides white and red backlight source. Each images is formed by mixing the two color fields. Specifically, as shown in FIG. 1*a*, within the first color field, the backlight module provides the white backlight source. The transparent, green, and blue subpixels within the pixel cells are in a turn-on state, and thus the first color field includes image information of WGB colors. As shown in FIG. 1*b*, within the second color field, the white backlight source is turned off. The backlight module provides red backlight source. At the same time, the green and blue subpixels are in a turn-off state. The transparent subpixel is in the turn-on state. In this way, the backlight displays the image information of R color, and then two color fields are mixed to obtain a complete colorful image.

Within the second color field, the green and blue subpixels are in the turn-off state. Within the first color field of next image, the green and blue subpixels are in the turn-on state, and the transparent subpixel remains in the turn-on state. FIG. 2 shows the response rates of the subpixels of the first image at 128 gray level, wherein W1 represents grayscale values of the white pixel in the first color field, R1 represents grayscale values of the red pixel in the first color field, G1/B1 represent response rates of the green/blue subpixels in the first color field. W2, R2, R3, G2/B2, G3/B3 may be understood in a similarly way. As the response rate is not quick enough, within the same duration, the green and the blue subpixels need a longer time to obtain the grayscale values equaling to 128 than the red subpixel, which results in the color shift issue.

SUMMARY

In order to overcome the above problem, the driving method of the FSC-LCD may be applied to the LCD for displaying a plurality of consecutive images. The FSC-LCDs own the attributes, such as high color range, high transmission rate, and low power consumption. Also, color breakup issue of the FSC-LCDs is enhanced and the refresh rate of images is reduced.

In one aspect, a driving method of field-sequential-color liquid crystal device (FSC-LCD) for driving the LCD to display a plurality of consecutive images. Each pixel cell of the LCD comprises a transparent subpixel, a first color subpixel, and a second color subpixel, and each of the images comprises a first color field and a second color field. The method includes: calculating grayscale values of four pixels of each images, the grayscale values of four pixels comprises grayscale values for a white pixel, for a first color pixel, for a second color pixel, and for a third color pixel; within a first color field of the n-th image, a white backlight source is provided to the pixel cells, the grayscale value for the white pixel of the n-th image is inputted to the transparent subpixel, the grayscale value for the first color pixel of the n-th image is inputted to the first color subpixel, and the grayscale value for the second color pixel of the n-th image is inputted to the second color subpixel; within a second color field of the n-th image, a third-color backlight source is provided to the pixel cells, the grayscale value for the third color pixel of the n-th image is inputted to the transparent subpixel, a grayscale value is inputted to the first color subpixel and the second color subpixel such that the first color subpixel and the second color subpixel remain in a turn-on state; wherein n is an integer greater than 0; and within the second color field of the 0-th image, the grayscale value for the white pixel of the first image is inputted to the first color subpixel and the second color subpixel, and the 0-th image is a booting image displayed when the LCD boots.

Wherein within the second color field of the n-th image, the grayscale value for the white pixel of the (n+1)-th image is inputted to the first color subpixel and the second color subpixel.

Wherein the first color is green, the second color is blue, and the third color is red.

Wherein the first color is green, the second color is red, and the third color is blue.

Wherein the first color is blue, the second color is red, and the third color is green.

Wherein the grayscale values of the four pixels of each images are calculated by a method for converting three RGB pixels to four RGBW pixels.

In another aspect, a field-sequential-color liquid crystal device (FSC-LCD), includes: a liquid crystal panel and a backlight module opposite to the liquid crystal panel, the backlight module provides a display light source to the liquid crystal panel such that the liquid crystal panel is capable of displaying images; the liquid crystal panel comprises a thin film transistor (TFT) substrate, a color filter (CF) substrate, and a liquid crystal layer between the TFT substrate and the CF substrate, wherein the CF substrate comprises a transparent photoresist, a first color photoresist, and a second color photoresist corresponding to each pixel cells, the backlight module comprises a first backlight source and a second backlight source, the first backlight source is a white backlight source, and the second backlight source is the backlight source adopting a third-color. The FSC-LCD is driven by the above driving method.

Wherein the first and the second color photoresist are respectively green and blue photoresists and the third-color backlight source is a red backlight source.

Wherein the first and the second color photoresist are respectively green and red photoresists, and the third-color backlight source is a blue backlight source.

Wherein the first and the second color photoresist are respectively blue and red photoresists, and the third-color backlight source is a green backlight source In view of the above, the driving method may be applied for the LCD having two kinds of photoresists and one transparent photoresist. When the first color field and the second color field of each image are driven, all of the subpixels of one pixel cell are in the turn-on state. As such, the differences between the response rates of the liquid crystals corresponding to each subpixel are relatively small, which solves the color shift issue.

DETAILED DESCRIPTION OF THE EMBODIMENTS

Figure 1:
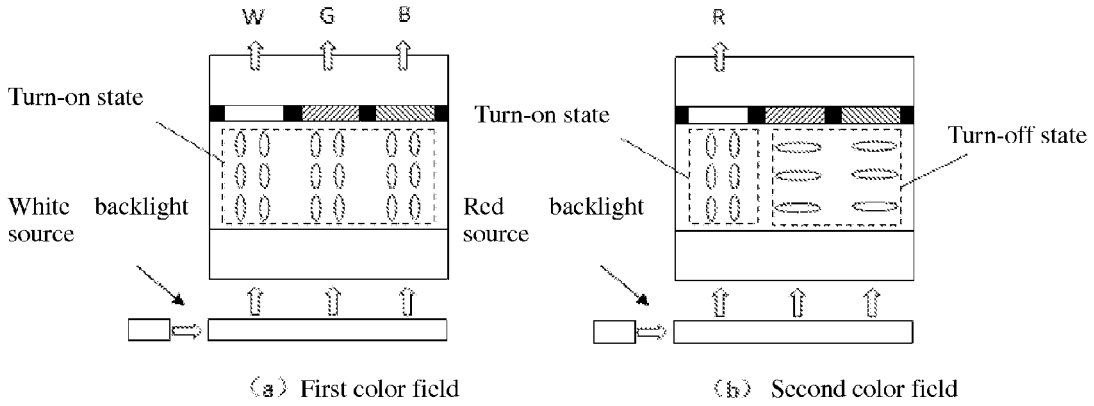
Fig. 1 (prior art)
FIG. 1 is a schematic view of one conventional FSC-LCD and the driving process thereof.
Figure 2:
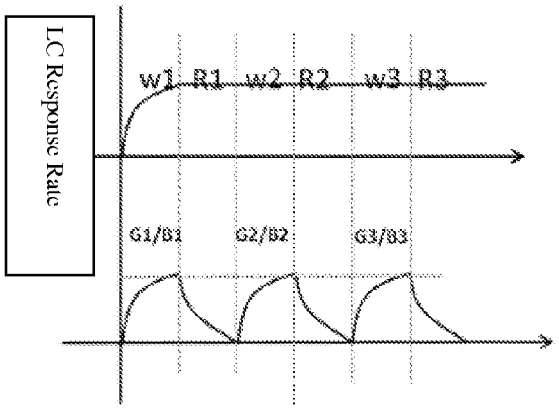
Fig. 2 (prior art)
FIG. 2 is a schematic view of a response rate of the liquid crystal during the driving process of the FSC-LCD of FIG. 1.

Various example embodiments will now be described more fully with reference to the accompanying drawings in which some example embodiments are shown. In the drawings, the thicknesses of layers and regions may be exaggerated for clarity. In the following description, in order to avoid the known structure and/or function unnecessary detailed description of the concept of the invention result in confusion, well-known structures may be omitted and/or functions described in unnecessary detail.

The object of the claimed invention is to provide a FSC-LCD and the driving method thereof so as to solve the color shift issue resulting from the huge differences of response rates of the liquid crystals corresponding to each subpixels within a pixel cell.

The FSC-LCD includes a liquid crystal panel and a backlight module arranged opposite to the liquid crystal panel. The backlight module provides a display source to the liquid crystal panel such that the liquid crystal panel is capable of displaying images. Each image is mixed by a first color field and a second color field. The liquid crystal panel includes a thin film transistor (TFT) substrate, a color filter (CF) substrate opposite to the TfT substrate, and a liquid crystal layer between the TFT substrate and the CF substrate. The CF substrate includes a transparent photoresist, a first color photoresist, and a second color photoresist corresponding to each of the pixel cells. The CF substrate also includes a transparent subpixel, a first color subpixel and a second color subpixel corresponding to each of the pixel cells. The first color and the second color may be any two out of red, green, and blue. The other color out of red, green, and blue is deemed as a third color. The backlight module includes a first backlight source and a second backlight source. The first backlight source is a white backlight source, and the second backlight source is the backlight source adopting the third color ("third-color backlight source").

The driving method of the FSC-LCD includes the following steps.

In step (a), grayscale values of four pixels of each images are calculated. The grayscale values of the four pixels includes grayscale values for a white pixel, for a first color pixel, for a second color pixel, and for a third color pixel.

In step (b), within a first color field of the n-th image, a white backlight source is provided to the pixel cells. The grayscale value for the white pixel of the n-th image is inputted to the transparent subpixel. The grayscale value for the first color pixel of the n-th image is inputted to the first color subpixel. The grayscale value for the second color pixel of the n-th image is inputted to the second color subpixel.

In step (c), within a second color field of the n-th image, the third-color backlight source is provided to the pixel cells. The grayscale value for the third color pixel of the n-th image is inputted to the transparent subpixel. A grayscale value is inputted to the first color subpixel and the second color subpixel such that the first color subpixel and the second color subpixel remain in a turn-on state, wherein n is an integer greater than 0.

Within the second color field of the 0-th image, the grayscale value for the white pixel of the first image is inputted to the first color subpixel and the second color subpixel. The 0-th image relates to the image when the LCD is in a booting state.

By driving the first color field and the second color field of each images, all of the subpixels of each pixel cells are in the turn-on state. As such, the differences between the response rate of the liquid crystals corresponding to each subpixels are relatively small, which solves the color shift issue.

The technical features and the structure of the FSC-LCD will be described in more detail hereinafter.

Figure 3:
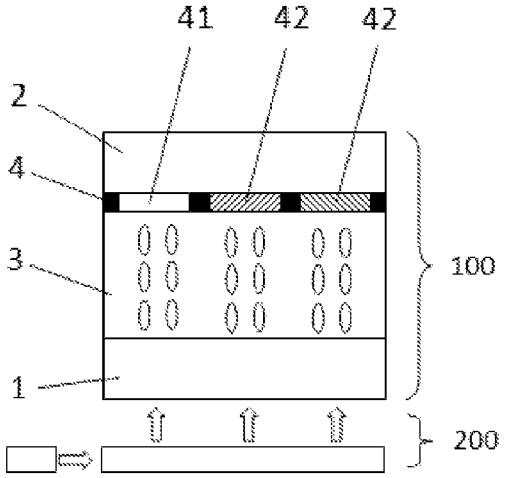
FIG. 3 is a schematic view of the FSC-LCD in accordance with one embodiment.

FIG. 3 is a schematic view of the FSC-LCD in accordance with one embodiment. As shown, the FSC-LCD includes two color photoresists and a transparent photoresist. In this example, the two color photoresists are green and blue photoresist. The FSC-LCD includes a liquid crystal panel 100 and a backlight module 200. The backlight module 200 provides a display light source to the liquid crystal panel 100 such that the liquid crystal panel 100 is capable of displaying images. The liquid crystal panel 100 includes a TFT substrate 1, a CF substrate 2, and a liquid crystal layer 3 between the TFT substrate 1 and the CF substrate 2.

A CF 4 of the CF substrate 2 includes a transparent photoresist 41, a green photoresist 42, and a blue photoresist 43 respectively corresponding to a transparent subpixel, a green subpixel, and a blue subpixel of each pixel cells. The backlight module 200 includes a first backlight source and a second backlight source. The first backlight source is a white backlight source, and the second backlight source is the red backlight source.

Figure 4:
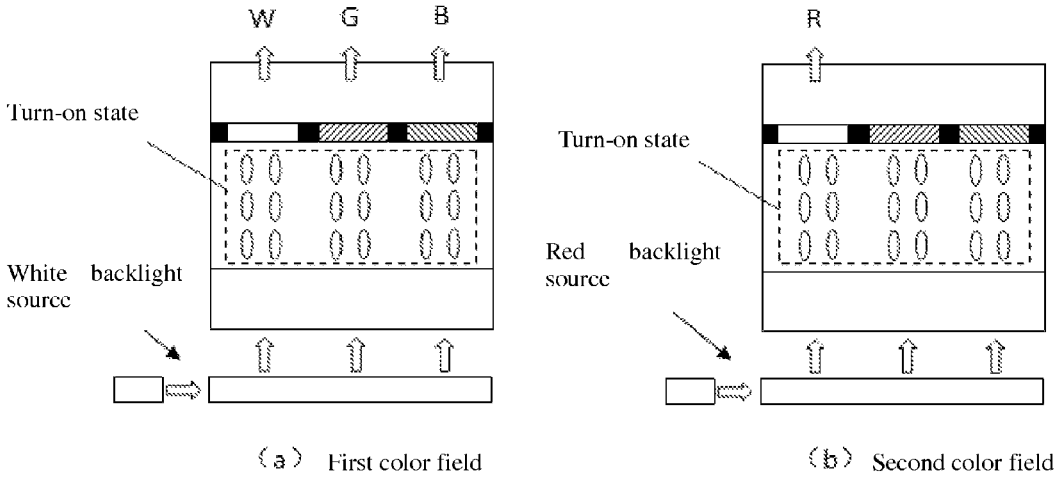
FIG. 4 is a schematic view showing a displaying process of one image of the FSC-LCD of FIG. 3.
Figures 5, 6:
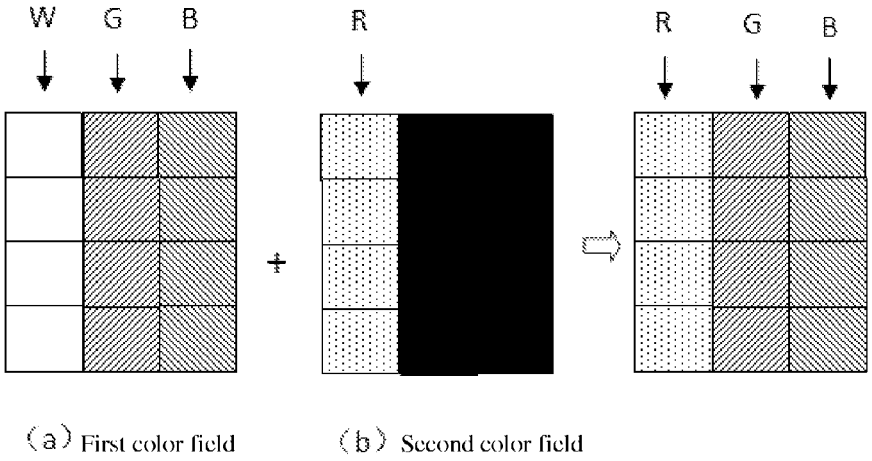
FIG. 5 is a schematic view of the image information obtained in the displaying process of FIG. 4.
FIG. 6 is a schematic view of the driving method of the FSC-LCD in accordance with one embodiment.

Referring to FIGS. 4-6, the driving process of the FSC-LCD includes:

For a plurality of consecutive images, the grayscale values of four pixels of each images are calculated first. The grayscale values of the four pixels includes grayscale values for the white pixel (W), for the red pixel (R), for the green pixel (G), and for the blue pixel (B). For instance, the grayscale values for the four pixels of the first image are respectively represented by W1, R1, G1, and B1. The grayscale values for the four pixels of the second image are respectively represented by W2, R2, G2, and B2. The grayscale values for the four pixels of the third image are respectively represented by W3, R3, G3, and B3. The grayscale values for the four pixels of the fourth image are respectively represented by W4, R4, G4, and B4. The grayscale values of the four pixels of each images may be calculated by any solutions for converting three RGB pixels to four RGBW pixels.

Second, referring to FIG. 6, when the FSC-LCD displays a booting image, i.e., the 0-th image, the backlight source is turned off within the first color field of the 0-th image. It is not needed to provide input signals to the transparent subpixel, green subpixel, and blue subpixel. Within the second color field of the 0-th image, it is not needed to provide the input signals to the transparent subpixel. The grayscale value for the white pixel (W1) of the first image is inputted to the green subpixel and the blue subpixel.

Third, referring to FIG. 4*a*, within the first color field of the n-th image, the white backlight source is provided to the pixel cell. The grayscale value for the white pixel of the n-th image is inputted to the transparent subpixel. The grayscale value for the green pixel of the n-th image is inputted to the green subpixel. The grayscale value for the blue pixel of the n-th image is inputted to the blue subpixel. Referring to FIG. 6, within the first color field of the first image, the white backlight source, indicated by "W" in FIG. 6, is provided to the pixel cell. The grayscale value for the white pixel (W1) of the first image is inputted to the transparent subpixel. The grayscale value for the green pixel (G1) of the first image is inputted to the green subpixel. The grayscale value for the blue pixel (B1) of the first image is inputted to the blue subpixel. In this way, the first color field includes image information having WGB colors (see FIG. 5*a*).

Fourth, referring to FIG. 4*b*, within the second color field of the n-th image, the red backlight source is provided to the pixel cell. The grayscale value for the red pixel of the n-th image is inputted to the transparent subpixel. The grayscale value for the white pixel of the (n+1)-th image is inputted to the green and blue subpixel such that the green and blue subpixels are in the turn-on state. In other embodiments, within the second color field of the n-th image, other grayscale values, which may keep the green and blue subpixels remaining in the turn-on state, may be inputted to the green and blue subpixels. In this embodiment, the grayscale value for the white pixel of the (n+1)-th image is inputted so as to enhance the display brightness. For instance, within the second color field of the first image, the red backlight source, as indicated by "R" in FIG. 6, may be provided to the pixel cells. The grayscale value for the red pixel of the first image is inputted to the transparent subpixel. The grayscale value for the white pixel of the second image is inputted to the green and blue subpixels. At this moment, the backlight module 200 provides the red backlight, Though the green and the blue subpixels remain in the turn-on state, red beams cannot pass the green photoresist 42 and the blue photoresist 43 due to the green photoresist 42 and the blue photoresist 43. In this way, referring to FIG. 5*b*, the red backlight displays the image information regarding red (R) after passing the CF. A complete RGB image is obtained by mixing the first color field and the second color field as shown in FIG. 5.

In view of the above, by driving the first color field and the second color field of each of the images, all of the subpixels of one pixel cell are in the turn-on state. As such, the differences between the response rate of the liquid crystals corresponding to each subpixels are relatively small, which solves the color shift issue. In addition, the FSC-LCD also owns the attributes, such as high color range, high transmission rate, and low power consumption. Also, color breakup issue of the FSC-LCD is enhanced and the refresh rate of images is reduced.

It should be noted that the relational terms herein, such as "first" and "second", are used only for differentiating one entity or operation, from another entity or operation, which, however do not necessarily require or imply that there should be any real relationship or sequence. Moreover, the terms "comprise", "include" or any other variations thereof are meant to cover non-exclusive including, so that the process, method, article or device comprising a series of elements do not only comprise those elements, but also comprise other elements that are not explicitly listed or also comprise the inherent elements of the process, method, article or device. In the case that there are no more restrictions, an element qualified by the statement "comprises a . . . " does not exclude the presence of additional identical elements in the process, method, article or device that comprises the said element.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A driving method of field-sequential-color liquid crystal device (FSC-LCD) for driving the LCD to display a plurality of consecutive images, each pixel cell of the LCD comprises a transparent subpixel, a first color subpixel, and a second color subpixel, each of the images comprises a first color field and a second color field, the method comprising:

calculating grayscale values of four pixels of each images, the grayscale values of four pixels comprises grayscale values for a white pixel, for a first color pixel, for a second color pixel, and for a third color pixel;

within a first color field of the n-th image, a white backlight source is provided to the pixel cells, the grayscale value for the white pixel of the n-th image is inputted to the transparent subpixel, the grayscale value for the first color pixel of the n-th image is inputted to the first color subpixel, and the grayscale value for the second color pixel of the n-th image is inputted to the second color subpixel;

within a second color field of the n-th image, a third-color backlight source is provided to the pixel cells, the grayscale value for the third color pixel of the n-th image is inputted to the transparent subpixel, a grayscale value is inputted to the first color subpixel and the second color subpixel such that the first color subpixel and the second color subpixel remain in a turn-on state;

wherein n is an integer greater than 0; and within the second color field of the 0-th image, the grayscale value for the white pixel of the first image is inputted to the first color subpixel and the second color subpixel, and the 0-th image is a booting image displayed when the LCD boots.

2. The driving method as claimed in claim 1, wherein within the second color field of the n-th image, the grayscale value for the white pixel of the (n+1)-th image is inputted to the first color subpixel and the second color subpixel.

3. The driving method as claimed in claim 2, wherein the first color is green, the second color is blue, and the third color is red.

4. The driving method as claimed in claim 3, wherein the grayscale values of the four pixels of each images are calculated by a method for converting three RGB pixels to four RGBW pixels.

5. The driving method as claimed in claim 2, wherein the first color is green, the second color is red, and the third color is blue.

6. The driving method as claimed in claim 5, wherein the grayscale values of the four pixels of each images are calculated by a method for converting three RGB pixels to four RGBW pixels.

7. The driving method as claimed in claim 2, wherein the first color is blue, the second color is red, and the third color is green.

8. The driving method as claimed in claim 7, wherein the grayscale values of the four pixels of each images are calculated by a method for converting three RGB pixels to four RGBW pixels.

9. A field-sequential-color liquid crystal device (FSC-LCD), comprising:

a liquid crystal panel and a backlight module opposite to the liquid crystal panel, the backlight module provides a display light source to the liquid crystal panel such that the liquid crystal panel is capable of displaying images;

the liquid crystal panel comprises a thin film transistor (TFT) substrate, a color filter (CF) substrate, and a liquid crystal layer between the TFT substrate and the CF substrate, wherein the CF substrate comprises a transparent photoresist, a first color photoresist, and a second color photoresist corresponding to each pixel cells, the backlight module comprises a first backlight source and a second backlight source, the first backlight source is a white backlight source, and the second backlight source is the backlight source adopting a third-color, wherein the LCD is driven by a driving method comprising:

calculating grayscale values of four pixels of each images, the grayscale values of four pixels comprises grayscale values for a white pixel, for a first color pixel, for a second color pixel, and for a third color pixel;

within a first color field of the n-th image, a white backlight source is provided to the pixel cells, the grayscale value for the white pixel of the n-th image is inputted to a transparent subpixel, the grayscale value for the first color pixel of the n-th image is inputted to the first color subpixel, and the grayscale value for the second color pixel of the n-th image is inputted to the second color subpixel;

within a second color field of the n-th image, a third-color backlight source is provided to the pixel cells, the grayscale value for the third color pixel of the n-th image is inputted to the transparent subpixel, a grayscale value is inputted to the first color subpixel and the second color subpixel such that the first color subpixel and the second color subpixel remain in a turn-on state;

wherein n is an integer greater than 0; and within the second color field of the 0-th image, the grayscale value for the white pixel of the first image is inputted to the first color subpixel and the second color subpixel, and the 0-th image is a booting image displayed when the LCD boots.

10. The FSC-LCD as claimed in claim 9, wherein within the second color field of the n-th image, the grayscale value for the white pixel of the (n+1)-th image is inputted to the first color subpixel and the second color subpixel.

11. The FSC-LCD as claimed in claim 10, wherein the first and the second color photoresist are respectively green and blue photoresists, and the third-color backlight source is a red backlight source.

12. The FSC-LCD as claimed in claim 11, wherein the grayscale values of the four pixels of each images are calculated by a method for converting three RGB pixels to four RGBW pixels.

13. The FSC-LCD as claimed in claim 10, wherein the first and the second color photoresist are respectively green and red photoresists, and the third-color backlight source is a blue backlight source.

14. The FSC-LCD as claimed in claim 13, wherein the grayscale values of the four pixels of each images are calculated by a method for converting three RGB pixels to four RGBW pixels.

15. The FSC-LCD as claimed in claim 10, wherein the first and the second color photoresist are respectively blue and red photoresists, and the third-color backlight source is a green backlight source.

16. The FSC-LCD as claimed in claim 15, wherein the grayscale values of the four pixels of each images are calculated by a method for converting three RGB pixels to four RGBW pixels.

* * * * *